US005586828A

United States Patent [19]

Nakata

[11] Patent Number: 5,586,828

[45] Date of Patent: Dec. 24, 1996

[54] PRINTER WITH PRINTING HAMMER

[75] Inventor: Takashi Nakata, Aichi-ken, Japan

[73] Assignee: Brother Kogyo Kabushiki Kaisha, Nagoya, Japan

[21] Appl. No.: 364,317

[22] Filed: Dec. 27, 1994

[30] Foreign Application Priority Data

Dec. 28, 1993 [JP] Japan ..... 5-350872

[51] Int. Cl.[6] ..... B41J 23/34

[52] U.S. Cl. ..... 400/185; 400/157.1; 400/212; 400/229

[58] Field of Search ..... 400/157.1, 157.2, 400/185, 187, 212, 214, 229, 320, 322, 323, 328, 897.1

[56] References Cited

U.S. PATENT DOCUMENTS 4,746,236 5/1988 Shioda ..... 400/157.1
4,893,950 1/1990 Ragen et al. ..... 400/212

FOREIGN PATENT DOCUMENTS 60-009793 1/1985 Japan ..... 400/185
60-087075 5/1985 Japan ..... 400/185
61-066678 4/1986 Japan ..... 400/185

*Primary Examiner*—David A. Wiecking
*Attorney, Agent, or Firm*—Oliff & Berridge

[57] ABSTRACT

The printer such that when characters are printed, a carriage is moved in a printing direction. Corresponding to the direction of the movement of the carriage, a printing hammer driving mechanism is selected through a pivotal lever, a pendulum member, and a selecting member. In this state a solenoid is energized to make the printing hammer driving mechanism operate. When misprinted characters are to be corrected, the carriage is first moved in a character correcting direction and, corresponding to the direction of the movement of the carriage, a ribbon lift mechanism is selected through the pivotal lever, the pendulum member, and the selecting member. In this state the solenoid is energized to make the ribbon lift mechanism operate. Thereby, either the printing hammer driving mechanism or the correction ribbon lift mechanism can be selected, and these mechanisms can be selectively connected to the driving motor by one solenoid corresponding to the direction of the movement of the carriage, which makes it possible to offer a printer of low cost by decreasing the number of solenoids.

20 Claims, 9 Drawing Sheets

PRINTER WITH PRINTING HAMMER

BACKGROUND OF THE INVENTION

1. Field of the Invention

The invention relates to a printer, such as a typewriter, which uses a type wheel having a plurality of type elements mounted on a carriage and performs the printing of characters on a printing paper by striking a type with a printing hammer from behind through a printing ribbon in selecting the type out of the type elements, and further misprinted characters can be corrected by use of a correction ribbon; in particular, it relates to a printer in which a printing hammer driving mechanism which drives the printing hammer and a correction ribbon lift mechanism which shifts a correction ribbon up or down when a misprinted character is corrected can be selected by one solenoid corresponding to the movement of the carriage.

2. Description of the Related Art

Various types of printers have been proposed: each of the printers uses a type wheel having a plurality of type elements, the type wheel is mounted on a carriage and performs the printing of characters on a printing paper by striking a type selected out of the type elements from behind with a printing hammer through a printing ribbon and further they are able to perform the correction of misprinted characters using a correction ribbon.

For example, in U.S. Pat. No. 4,746,236, a printer, such as a typewriter, is described, which comprises: a clutch means for a hammer operation mechanism which corresponds to the printing hammer operation mechanism and an electromagnet for the hammer operation which makes the hammer operation mechanism operable, and a clutch means for a lift mechanism which corresponds to the correction ribbon lift mechanism and an electromagnet for the lift mechanism which makes the lift mechanism operable. In the typewriter, it is arranged that the printing hammer operation mechanism and the lift mechanism can be selectively connected to one driving motor by selectively operating respective electromagnetic magnets and respective clutch means.

In a printer as described in the respective official gazettes, in a case where the printing of characters is to be performed by striking type elements on a type wheel with a printing hammer by the operation of a hammer operation mechanism, the hammer operation mechanism is made to operate by driving an electromagnet for the hammer operation. A driving motor is connected to the printing hammer operation mechanism by a clutch means for the hammer operation; thereby, characters are printed on a printing paper by striking the type elements with the printing hammer. In a case where misprinted characters on the printing paper are to be corrected using a correction ribbon brought to position by a lift mechanism for the correction ribbon, a carriage is moved to the position of the misprinted character and the lift mechanism is operated by driving an electromagnet for the lift mechanism, and the correction ribbon is moved upward in connecting the driving motor to the lift mechanism by the clutch means for the lift mechanism. After that, the driving motor is connected to the printing hammer operation mechanism by the clutch means for the hammer operation to drive the electromagnet for hammer operation and the type element is struck with the printing hammer; thus the correction of misprinted characters can be performed.

SUMMARY OF THE INVENTION

In the case of the printer described in the above-mentioned U.S. Pat. No. 4,746,236, an electromagnet is provided for each of the printing hammer operation mechanism and the lift mechanism for a correction ribbon increasing the cost of the printer and making it difficult to reduce the manufacturing cost of the printer.

The above-mentioned printing hammer operation mechanism and lift mechanism are disposed on the carriage so that it becomes necessary to mount an electromagnet for the hammer operation and another electromagnet for the lift mechanism on the carriage; therefore, space for disposing two electromagnets must be provided on the carriage increasing the carriage size, which also makes it difficult to reduce the cost of the printer.

The invention is directed to solving the problems described above. An object of the invention is to offer a printer in which the printing hammer driving mechanism or the lift mechanism for a correction ribbon Can be selectively connected to the driving motor with one solenoid corresponding to the reciprocating strokes of the carriage.

In order to achieve the above-mentioned object, a printer according to the invention has the structure which comprises the following:

a carriage movement mechanism which reciprocatingly moves a carriage, mounted with a type wheel having a plurality of type elements, in a first direction or a second direction along a platen, a pivotal mechanism, having a pair of stopping portions having a first and a second stopping portion, is turned to a first position when the carriage is moved in the first direction and turned to the second position when the carriage is moved in the second direction by the above-mentioned carriage movement mechanism, an operation mechanism comprising a rotating body, having a first supporting portion and a second supporting portion, which is rotated by a driving motor, a first cylindrical member which is engaged with the first supporting portion with play being provided with a first stopping projection in the circumference, a second cylindrical member which is engaged with the second supporting portion with play being provided with a second stopping projection in the circumference, a first clutch mechanism which connects or disconnects the transmission of the rotating force from the rotating body being disposed between the first supporting portion and the first cylindrical member, a second clutch mechanism which connects or disconnects the transmission of the rotating force from the rotating body being disposed between the second supporting portion and the second cylindrical member, a hammer cam member which is rotated following the rotation of the first cylindrical member, and a lift cam member which is rotated following the rotation of the second cylindrical member, a printing hammer driving mechanism which strikes type elements on the type wheel with the printing hammer corresponding to the rotation of the above-mentioned hammer cam member, a ribbon lift mechanism which shifts a correction ribbon up or down corresponding to the rotation of the lift cam member, a selecting mechanism comprising a first selecting member in which a first engagement portion is provided which can be selectively engaged with the first stopping portion of the above-mentioned pivotal mechanism and which has a first stopping claw to be engaged with the first stopping projection of the first cylindrical member and selects the printing hammer driving mechanism, and a second selecting member in which a second engagement portion is provided which can be selectively engaged with the second stopping portion of the pivotal mechanism and which has a second stopping claw to be engaged with the second stopping projection of the second cylindrical member and selects the ribbon lift mechanism, and a solenoid mechanism which releases the engagement of the first stopping claw with the first stopping projection of the first cylindrical member in a state where the first stopping projection of the above-mentioned pivotal mechanism is being engaged with the first engagement portion of the first selecting member and also releases the engagement of the second stopping claw with the second stopping projection of the second cylindrical member in a state where the second stopping portion of the pivotal mechanism is being engaged with the second engagement portion of the second selecting member.

In the case of a printer according to the invention having the structure described above, when the carriage is moved in the first direction along the platen by the carriage movement mechanism, the pivotal mechanism is turned to a first position corresponding to the movement of the carriage. A first stopping portion of the pivotal mechanism which is rotated to the first position is engaged with a first engagement portion of a first selecting member in the selecting mechanism, and a first stopping claw of the first selecting member is engaged with a first stopping projection of the first cylindrical member which is engaged with the first supporting portion of the rotating body with play. In this state, the rotating force transmitted to the first cylindrical member from the rotating body rotated by a driving motor is disconnected by a first clutch mechanism and the rotation of the first cylindrical member is stopped by the engagement of the first stopping claw with the first stopping projection.

After that, when the solenoid is excited in the state where the first stopping portion of the pivotal mechanism is engaged with the first engagement portion of the first selecting member, the engagement of the first stopping claw with the first stopping projection is released; thereby the operating connection between the rotating body and the first cylindrical member is recovered through the first clutch mechanism. As a result, the hammer cam member is rotated following the rotation of the first cylindrical member, and the printing hammer in the printing hammer driving mechanism strikes a type element on the type wheel corresponding to the rotation of the hammer cam member. In this way, the printing of characters is performed.

When the carriage is moved in the second direction along the platen by the carriage movement mechanism, the pivotal mechanism is turned to the second position corresponding to the movement of the carriage. The second stopping portion of the pivotal mechanism, which is turned to a second position, is engaged with a second engagement portion of a second selecting member in the selecting mechanism and, because the second stopping claw of the second selecting member is engaged with a second stopping projection of the second cylindrical member which is engaged with the second supporting portion of the rotating body with play. In this state, the rotating force to be transmitted to the second cylindrical member from the rotating body rotated by the driving motor is disconnected by the second clutch mechanism and, since the second stopping claw is engaged with the second stopping projection, the rotation of the second cylindrical member is in a stationary state.

After that, when the solenoid is excited in the state where the second stopping portion of the pivotal mechanism is engaged with the second engagement portion of the second selecting member, the engagement of the second stopping claw with the second stopping projection is released, thereby the rotating body and the second cylindrical member are connected to each other through the second clutch mechanism. As a result, the lift cam member is rotated following the rotation of the second cylindrical member and the correction ribbon is shifted up or down by the ribbon lift mechanism corresponding to the rotation of the lift cam member.

As described in the above, in the invention the driving motor can be selectively connected to the printing hammer driving mechanism or to the correction ribbon lift mechanism by one solenoid corresponding to the reciprocating strokes of the carriage. This makes it possible to offer a printer in which costs can be reduced by decreasing the number of solenoids. The above-mentioned merit will have a great effect in the industrial field.

DETAILED DESCRIPTION OF THE PREFERRED EMBODIMENT

Figure 1:
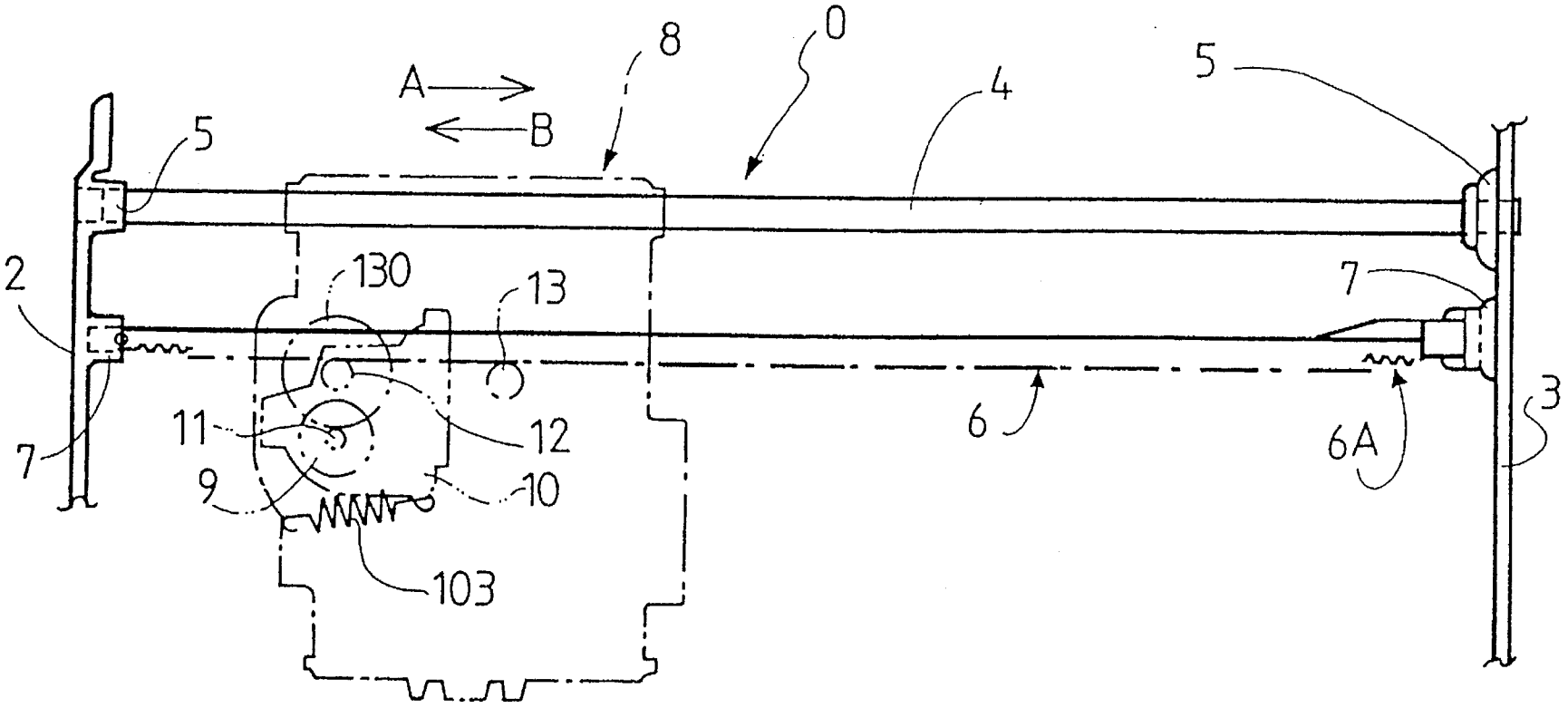
FIG. 1 is a plan view showing the outline of a typewriter.

In the following, an embodiment in which the invention is embodied in a typewriter will be explained in detail referring to the drawings. At first, the carriage movement mechanism O will be explained in detail referring to FIGS. 1 to 3.

As seen from these figures, the typewriter has a pair of side frames 2, 3. A carriage guide shaft 4 is fixed with fixing members 5 between the frames 2, 3, and, in a similar way to the above, a rack 6 is fixed with fixing members 7 in parallel to the guide shaft 4. The guide shaft 4 is inserted into a guide hole 14 provided on the carriage 8, which will be explained later, and the guide shaft 4 guides the carriage 8 in sliding when the carriage 8 makes reciprocating motions along the platen P. Rack teeth 6A are formed on the rack 6 and the rack teeth 6A are in gear with gear teeth 130B of an intermediate gear 130 which is in gear with pinion 11 of the carriage motor 9, which will be explained later. The rack 6 is preferably formed of a synthetic resin such as polystyrene, polyethylene, polyacetal, polyamide, or ABS resin.

Figure 2:
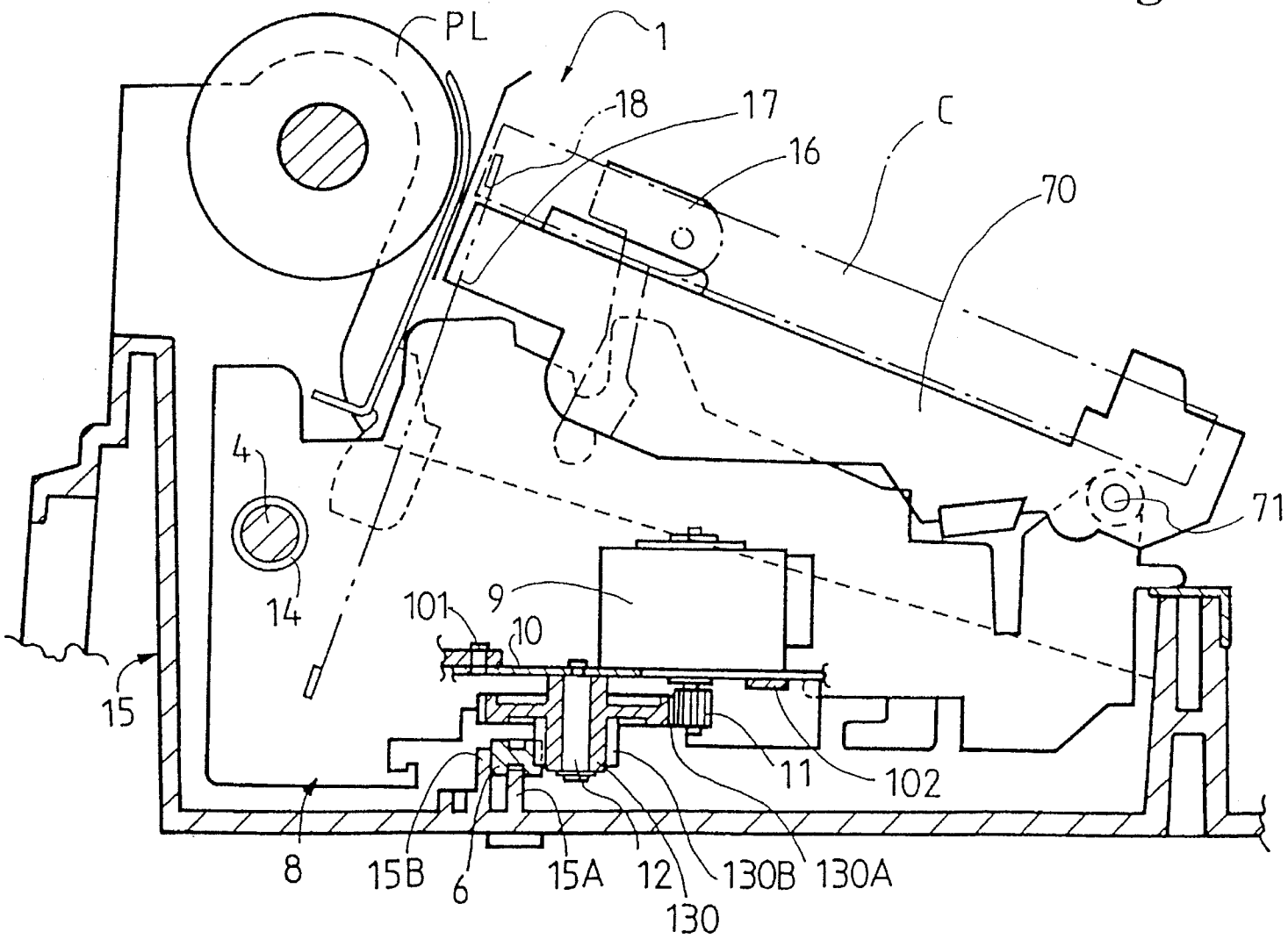
FIG. 2 is a lateral cross sectional view of a principal part of the typewriter.

The carriage 8 is, similar to the rack 6, preferably formed of a synthetic resin as a unitary structure. The carriage motor 9 is mounted on a plate 10 on the carriage 8. An end of the plate 10 is fixed rotatably on the carriage 8 so as to rotate about a shaft 101. Another end of the plate 10 is placed slidably on a supporting portion 102 of the carriage 8 The pinion 11, fixed on the motor shaft of the carriage motor 9, is in gear with the gear teeth 130A (shown in the upper part of FIG. 2) of the intermediate gear 130 which is fixed rotatably on the plate 10 by a shaft 12. The gear teeth 130B (shown in the lower part of FIG. 2) of the intermediate gear 130 are in gear with the rack teeth 6A of the rack 6. The rack 6, shown in FIG. 2, is fixed with projection portions, 15A and 15B formed on a bottom plate 15 disposed between the frames 2, 3. A pull spring 103 is provided between the plate 10 and the carriage 8 to energize the plate 10 toward the direction in which the gear teeth 130B of the intermediate gear 130 are to be in gear with the teeth 6A of the rack 6.

Figure 3:
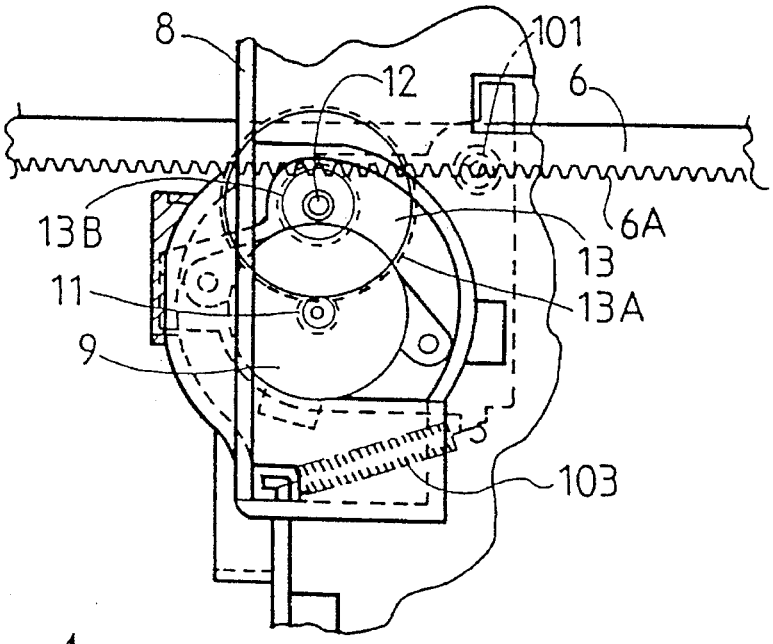
FIG. 3 is a plan view of a principal part of the carriage movement mechanism.

Therefore, as shown in FIG. 3, when the carriage motor 9 rotates clockwise, the intermediate gear 130 is rotated counterclockwise through the rotation of the pinion 11 which rotates in the same direction as the carriage motor 9; thereby, the carriage 8 is moved to the right in FIG. 1 and FIG. 3 through engagement of the gear teeth 130B of the intermediate gear 130 and the rack teeth 6A of the rack 6. On the other hand, when the carriage motor rotates counterclockwise in FIG. 3, the intermediate gear 130 is rotated clockwise through the pinion 11 which rotates in the same direction as that of the carriage motor 9; thereby, the carriage 8 is moved to the left in FIG. 1 and FIG. 3 through the gear teeth 130B of the intermediate gear 130 and the rack teeth 6A of the rack 6.

In the front position of the carriage 8 (to the left in FIG. 2), a guide hole 14 is formed. The guide shaft 4 is inserted through the guide hole 14. Further a platen PL is disposed rotatably between the frames 2, 3. A printing paper (not shown in a drawing) is wound around the platen PL, and the characters are printed on the printing paper by strikes applied from the back of type elements 18 on the type wheel 17 by the printing hammer which is driven through the printing hammer driving mechanism T, to be explained later.

A printing paper feed mechanism, which feeds the printing paper every time a character is printed by the printing hammer 16, and a type selecting mechanism, which selects a type element 18 on the type wheel 17, have the same mechanisms as those described in U.S. Pat. No. 4,746,236 which is explained in the preceding pages, "Description of the Related Art" the disclosure of which is incorporated by reference thereto, so that a detailed explanation of the printing paper feed mechanism and the type selecting mechanism is omitted.

Figure 4:
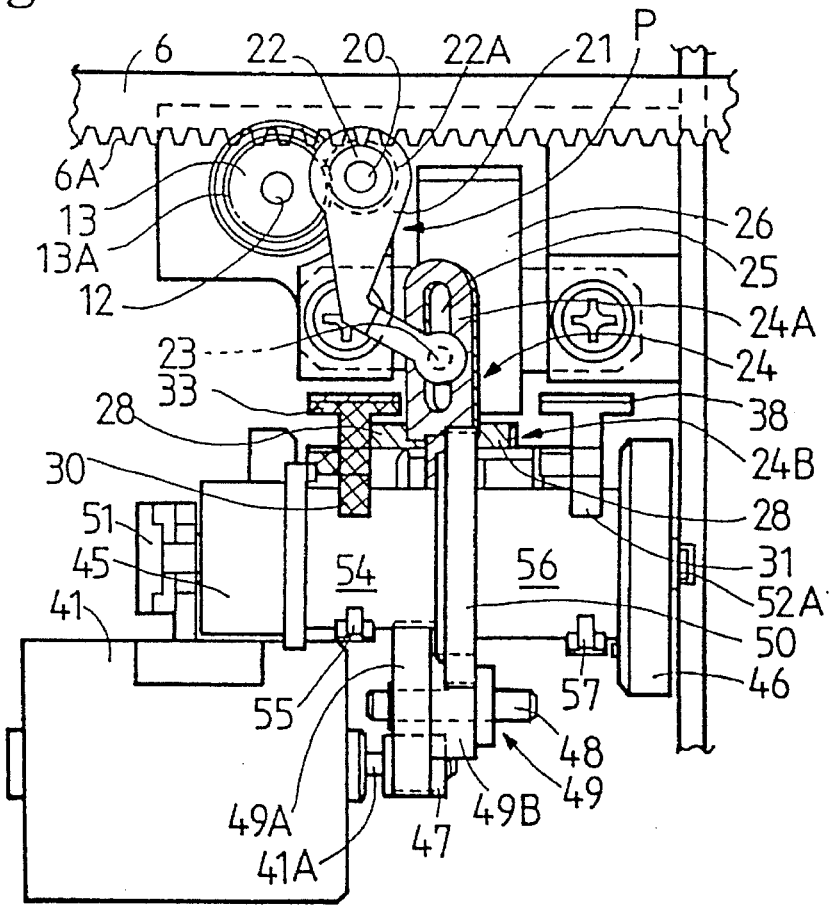
FIG. 4 is a plan view showing a state where the printing hammer driving mechanism is selected through the pivotal mechanism and the selecting mechanism based on the movement of the carriage.
Figure 5:
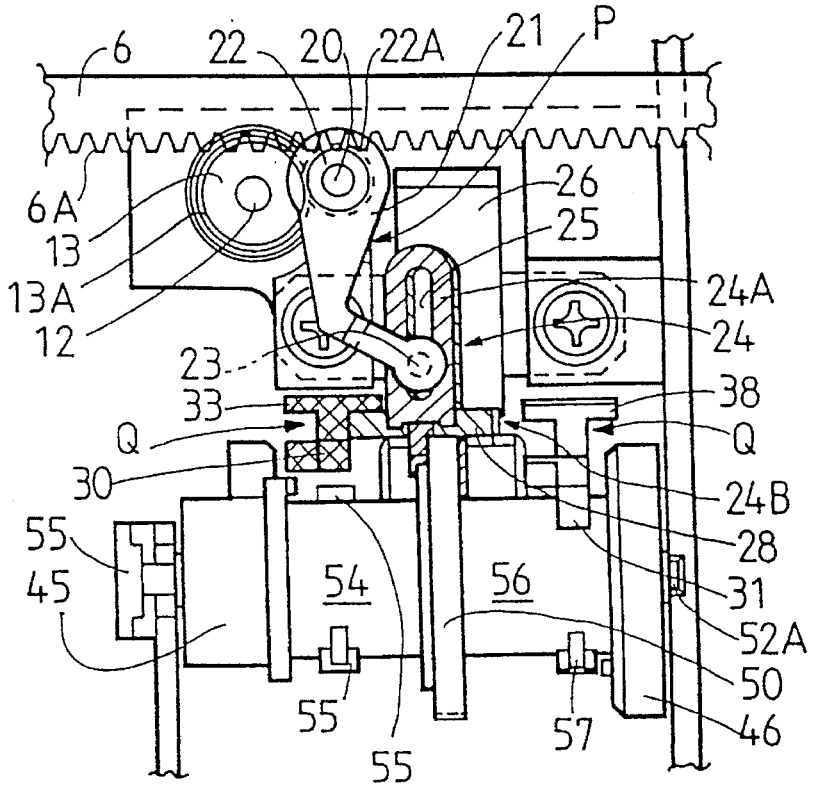
FIG. 5 is a plan view showing a state where a solenoid mechanism is triggered in the state shown in FIG. 4.
Figure 6:
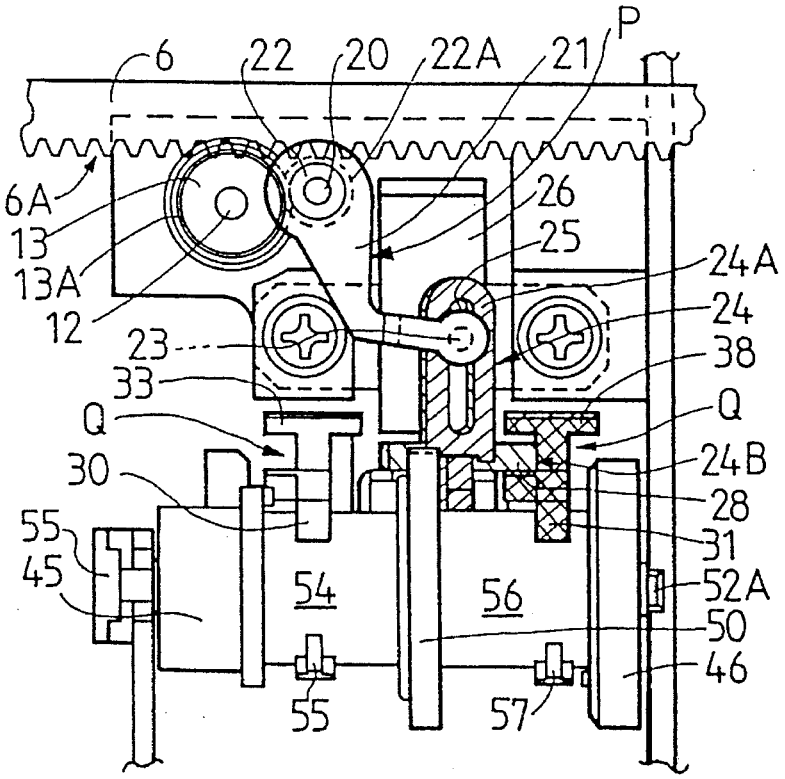
FIG. 6 is a plan view showing a state where the ribbon lift mechanism is selected through the pivotal mechanism based on the movement of the carriage.
Figure 7:
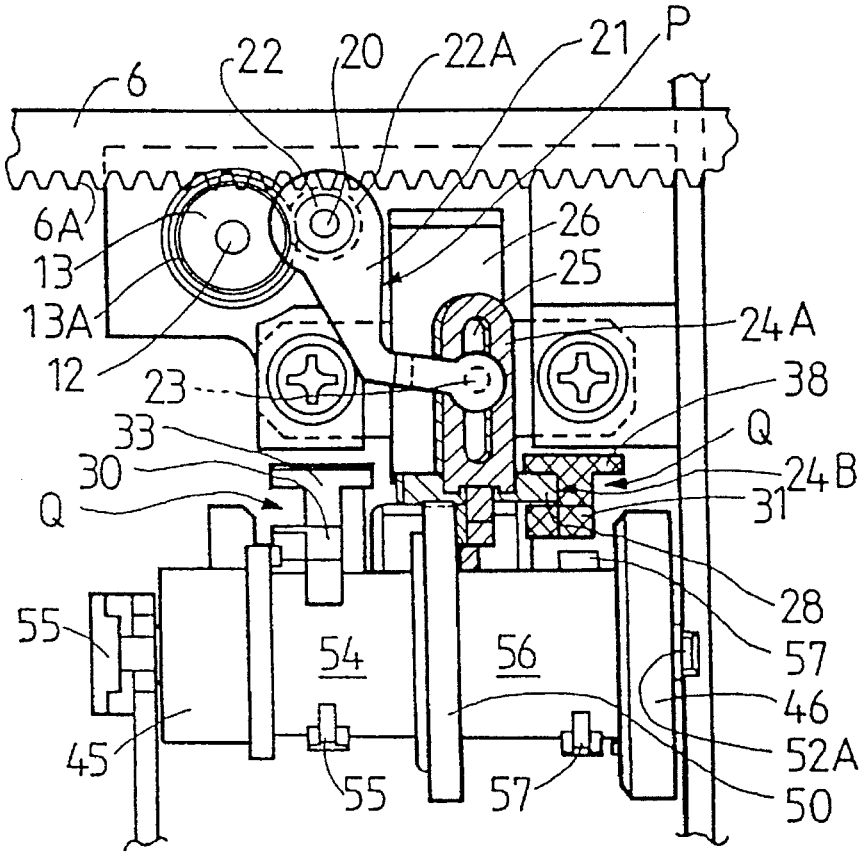
FIG. 7 is a plan view showing a state where the solenoid is triggered in the state shown in FIG. 6.
Figure 8:
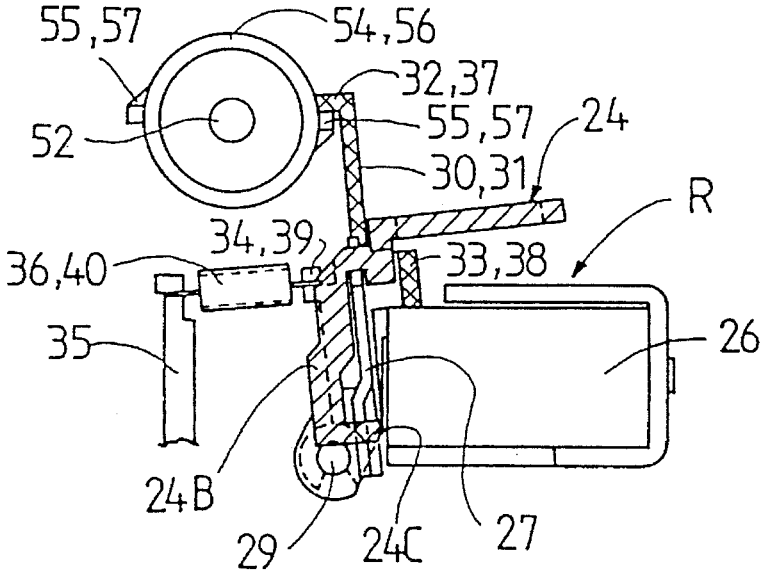
FIG. 8 is a typical side view of the solenoid in the state where the solenoid is not triggered.
Figure 9:
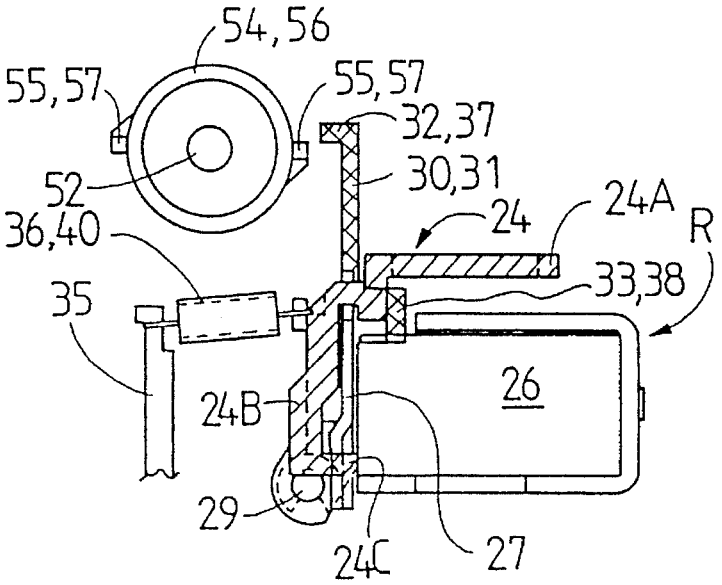
FIG. 9 is a typical side view of the solenoid in the state where the solenoid is triggered.
Figure 10:
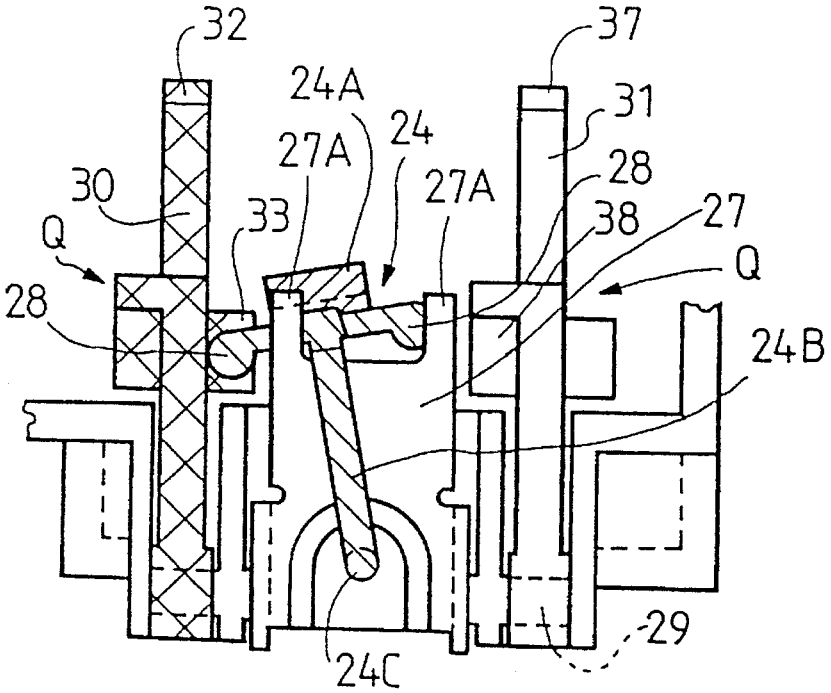
FIG. 10 is an illustrative representation showing the relation shift between a pendulum member and the armature of the solenoid corresponding to FIG. 4.
Figure 11:
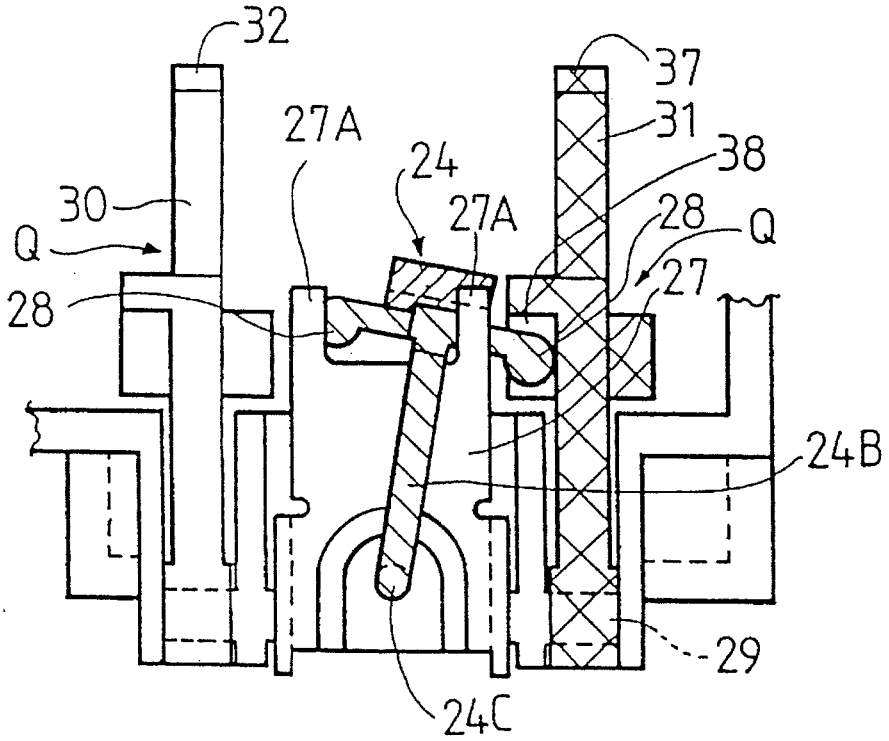
FIG. 11 is an illustrative representation showing the relation shift between the pendulum member and the armature of the solenoid corresponding to FIG. 6.
Figure 12:
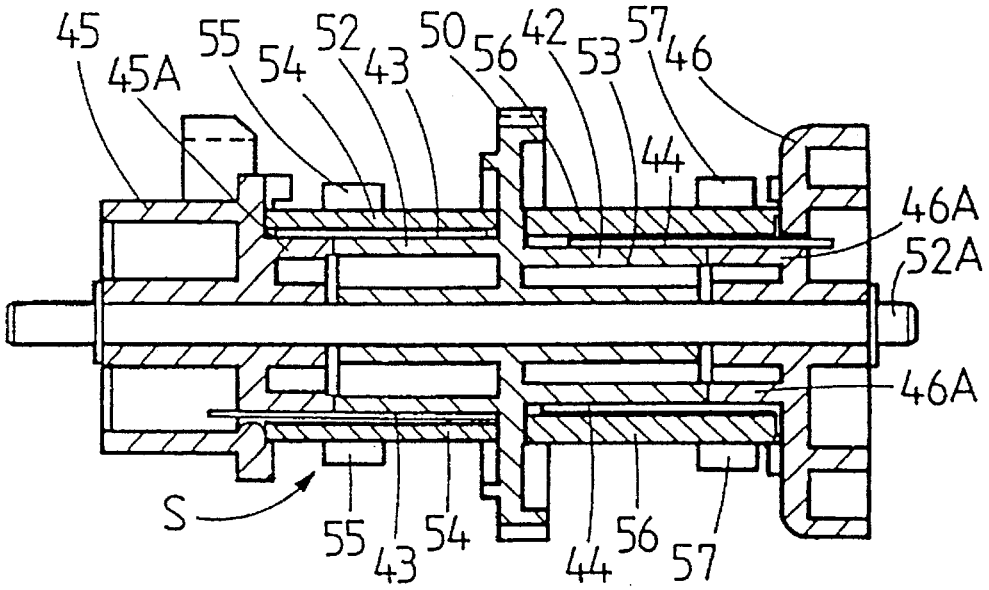
FIG. 12 is a cross sectional view showing the operation mechanism.

Referring to FIGS. 4 to 12, a pivotal mechanism P which is turned according to the movement of the carriage 8, a selecting mechanism Q which selects either the printing hammer driving mechanism T or the ribbon lift mechanism U for a correction ribbon based on the turn of the pivotal mechanism P, a solenoid mechanism R which is triggered in a state where either the printing hammer driving mechanism T or the ribbon lift mechanism U for a correction ribbon is selected by the selecting mechanism Q, and the operation mechanism S which is operated by the solenoid mechanism R will be explained. FIG. 4 is a plan view which shows the state where the printing hammer driving mechanism T is selected through the pivoting mechanism P and the selecting mechanism Q based on the movement of the carriage 8. FIG. 5 is a plan view which shows the state where the solenoid mechanism R is triggered in the state shown in FIG. 4. FIG. 6 is a plan view which shows the state where the ribbon lift mechanism U is selected through the pivotal mechanism P and the selecting mechanism Q based on the movement of the carriage 8. FIG. 7 is a plan view which shows the state where the solenoid is triggered in the state shown in FIG. 6. FIG. 8 is a typical side view which shows the solenoid mechanism which is not triggered. FIG. 9 is a typical side view which shows the solenoid mechanism which is triggered. FIG. 10 is an illustrative representation which shows the relationship between the pendulum member and the armature of the solenoid corresponding to FIG. 4. FIG. 11 is an illustrative representation which shows the relationship between the pendulum member and the armature of the solenoid corresponding to FIG. 6. FIG. 12 is a cross sectional view which shows the operation mechanism S.

The pivotal mechanism P, the selecting mechanism Q, the solenoid mechanism R, and the operation mechanism S are provided in the right side portion of the carriage movement mechanism O as shown in FIG. 1. In FIG. 1 only a passive gear 13 rotated by the reciprocal motion of the carriage 8 is shown. The passive gear 13 constitutes the pivotal mechanism P to be explained later.

In FIGS. 4 to 7, a shaft 20, which has a larger diameter in the head part than that of the shaft part, is fixed to the carriage 8 adjacent to the passive gear 13. A base end part of the pivotal lever 21 and a gear 22, having gear teeth 22A in gear with the passive gear 13, are fixed rotatably between the fixing surface of the shaft 20 to the carriage 8 and the lower end surface of the head part of the shaft 20. The gear 22 is abutted slidably against the lower end surface of the pivotal lever 21 as shown in FIG. 4. Although not clearly shown in the figures, there is provided a compression spring which is inserted into the shaft part of the shaft 20, between the fixing surface of the shaft 20 to the carriage 8 and the gear 22, so that the gear 22 and the pivotal lever 21 are pressed toward the lower end surface of the head part of the shaft 20.

The pivotal lever 21 has a dogleg shape and a pin 23 is provided downward in the tip end part of it. The gear 22 is constantly pressed against the pivotal lever 21 by the above-mentioned compression spring, so that the pivotal lever 21 is turned clockwise or counterclockwise by the rotation of the passive gear 13. When a load heavier than a predetermined value is loaded, slip occurs between the gear 22 and the pivotal lever 21. The pivotal lever 21 is arranged to stop at a position where it has been turned by a predetermined amount; thereby, the pivotal lever 21 is held at the position. In other words, a slip clutch lies between the above-mentioned gear 22 and the pivotal lever 21.

In the lower part of the pivotal lever 21, a pendulum member 24 is disposed on the carriage 8. The pendulum member 24 is fixed on the armature 27 of the solenoid 26. The relationship between the pendulum member 24 and the solenoid 26 will be explained referring to FIG. 4 and FIGS. 8 to 11. As shown in each figure, the pendulum member 24 has a connecting portion 24A in which a longish hole 25 is formed and in which the pin 23 of the pivotal lever 21 is engaged with play. A hanging-down portion 24B hangs from the connecting portion 24A. A supporting pin 24C is formed on an end of the hanging-down portion 24B and is supported rotatably by the armature 27 of the solenoid 26; thereby, the pendulum member 24 is supported rotatably by a pin 23 and the supporting pin 24C. The pendulum member 24 is held so as to be capable of being moved to the right and the left in FIG. 4 between a pair of control pieces 27A (FIG. 10). A pair of stopping portions 28 are formed in a part where the connecting portion 24A and the hanging-down portion 24B are connected (upper end portion of the hanging-down portion 24B, see FIGS. 10 and 11). Each of the stopping portions 28 is selectively engaged with an engagement piece 33, 38, formed respectively on a selecting member 30, 31, when the pendulum portion 24 is turned to the left or right.

The armature 27 of the solenoid 26 is supported rotatably to be able to rotate centering a shaft 29. The armature 27 is constantly energized to rotate counterclockwise in FIG. 8 through a pull spring which is not shown in a drawing. When the solenoid is energized, the armature 27 is rotated clockwise against the force of the pull spring and it is attracted electromagnetically by the solenoid 26 (Refer to FIG. 9).

Next, the selecting mechanism Q will be explained, which selects either the printing hammer driving mechanism T or the ribbon lift mechanism U for a correction ribbon through the turn of the pendulum member 24 which is turned by the pivotal lever 21. The selecting mechanism Q (FIG. 10) has a pair of selecting members 30, 31 which have the same shape and are disposed on each side of the pendulum member 24 (FIGS. 4 to 7). Each of the selecting members 30, 31 is supported to be pivotable by a shaft 29 which supports the armature 27 as shown in FIGS. 8 and 9.

In the case of the selecting member 30, a stopping claw 32 is formed at an upper end and an engagement piece 33 is formed in the central part on the side of the pendulum member 24. When the pendulum member 24 is turned counterclockwise (FIG. 10), the engagement piece 33 can be engaged with the stopping portion 28 of the pendulum member 24. A spring hanger piece 34 (FIG. 8) is formed in the central part of the selecting member 30 on the opposite side to that of the engagement piece 33, and a pull spring 36, which is similar to the pull spring of the armature 27, is provided between the spring hanger piece 34 and an upper end of a spring hanger member 35 which extends upwardly from the bottom wall of the carriage 8 (Refer to FIGS. 8 and 9). Therefore, the selecting member 30 is constantly energized counterclockwise (FIG. 8) by the force of the pull spring 36.

In the case of the other selecting member 31, a stopping claw 37 is formed on the upper end of it and an engagement piece 38 is formed in the central portion of it on the side of the pendulum member 24. When the pendulum member 24 is turned clockwise (FIG. 10), the engagement piece 38 can be engaged with the stopping portion 28 (FIG. 11). A spring hanging piece 39 is formed on the opposite side to that of the engagement piece 38 in the central portion of the selecting member 31, and a pull spring 40, which is similar to the pull spring 36, is provided between the spring hanger piece 39 and the upper end of another spring hanger member 35 which extends upwardly from the bottom wall of the carriage 8. Therefore, the selecting member 31 is, similar to the selecting member 30, constantly energized counterclockwise (FIG. 8) by the force of the pull spring 40.

The operation mechanisms, which operate the printing hammer driving mechanism T or the ribbon lift mechanism U for a correction ribbon, trigger the armature 27 which is turned by the solenoid 26. The operation mechanism S has a driving motor 41, a rotating body 42 which is rotated by the rotating force given by the driving motor 41, clutch springs 43, 44 disposed inside the rotating body 42, and a hammer cam 45 and a lift cam 46 which are rotated by the rotating force which is transmitted selectively from the rotating body 42 through the clutch springs 43, 44.

In FIG. 4, a driving motor 41, which is rotated in one direction, is provided on the carriage 8. A pinion 47 is fixed on the driving shaft 41A of the driving motor 41. An idle gear 49, which is supported rotatably by a shaft 48, is provided adjacent to the pinion 47 and two types of gear teeth 49A, 49B, are formed on the idle gear 49. The pinion 47 is in gear with the gear teeth 49A and a driven gear 50, which is formed into a unity with the rotating body 42, is in gear with the gear teeth 49B.

The rotating body 42, clutch springs 43, 44, the hammer cam 45, and the lift cam 46 will be explained with reference to FIG. 12. As shown in FIG. 12, in the vicinity of the driving motor 41, a supporting shaft 52A is supported between the side wall and the supporting wall 51 of the carriage 8. The rotating body 42 is supported rotatably by the supporting shaft 52A. The driven gear 50, which is to be in gear with the gear teeth 49B of the idle gear 49, is formed in unity with the rotating body 42. A first supporting portion 52 having a cylindrical shape (left side in FIG. 12) and a second supporting portion 53 of a cylindrical shape (right side in FIG. 12) are provided on both sides of the driven gear 50.

A first cylindrical member 54 is engaged with the first supporting portion 52 with play on the peripheral surface of the first cylindrical member 54 and two stopping projections 55 separated by an interval of 180 degrees. The stopping projections 55 are arranged to be capable of being engaged elastically with the stopping claw 32 of the selecting member 30. A clutch spring 43 is inserted between the first supporting portion 52 and the first cylindrical member 54. The clutch spring 43 has such a winding so as to reduce its diameter to make the clutch ON corresponding to the release of the engagement of the stopping projection 55 with the stopping claw 32 for the rotating body 42 which is rotated in one direction constantly. When the clutch is ON, the rotation of the rotating body 42 is selectively transmitted to the first cylindrical member 54. When the stopping projection 55 and the stopping claw 32 are engaged, the clutch spring 43 enlarges its diameter to disengage the clutch OFF and the rotation of the rotating body 42 is not transmitted to the first cylindrical member 54.

The hammer cam 45 is supported rotatably by the supporting shaft 52A adjacent to the rotating body 42. The clutch spring 43 is disposed between the small diameter portion 45A of the hammer cam 45 and the first cylindrical member 54. Therefore, when the diameter of the clutch spring 43 is reduced and the clutch is engaged ON, the rotation of the rotating body 42 is transmitted to the first cylindrical member 54 and also to the hammer cam 45. Thereby, when the engagement of the stopping projection 55 with the stopping claw 32 is released (explained later), the clutch spring 43 engages the clutch ON and the first cylindrical member 54 and the hammer cam 45 are rotated with the rotation of the rotating body 42.

The hammer cam 45 is formed to have a shape (FIG. 13) with depressed parts 45A formed at two positions opposing to each other (at an interval of 180 degrees) on the peripheral surface. A cam follower 69, which is provided on a function lever 63 in the printing hammer driving mechanism T (explained later), follows the peripheral surface of the hammer cam 45 by being abutted against it. When the cam follower 69 falls into one of the depressed parts, the function lever 63 is operated and the hammer 16 is driven to print characters, as described later. The second cylindrical member 56 is engaged with play with the second supporting portion 53 provided on the rotating body 42. The second cylindrical member 56 has two stopping projections 57 formed 180 degrees apart on the peripheral surface. The stopping claw 37 of the selecting member 31 can be engaged elastically with the stopping projection 57. A clutch spring 44 is inserted between the second supporting portion 53 and the second cylindrical member 56. The clutch spring 44 has such a winding as to reduce its diameter to engage the clutch ON corresponding to the release of the engagement of one of the stopping projections 57 with the stopping claw 37. When the clutch is engaged ON, the rotation of the rotating body 42 is transmitted selectively to the second cylindrical member 56. When the stopping projection 57 and the stopping claw 37 are engaged with each other, the diameter of the clutch spring 44 is enlarged to make disengage the clutch OFF. Thereby, the rotation of the rotating body is not transmitted to the second cylindrical member 56.

Further, the lift cam 46 is supported rotatably by the supporting shaft 52A adjacent to the rotating body 42. The clutch spring 44 is inserted between the small diameter portion 46A of the lift cam 46 and the second cylindrical member 56. Therefore, when the clutch is engaged ON by the reduction of the diameter of the clutch spring 44, as described above, the rotation of the rotating body 42 is transmitted to both the second cylindrical member 56 and lift cam 46. Thereby, when the engagement of the stopping projection 57 with the stopping claw 37 is released (to be described later), the clutch spring 44 engages the clutch ON and both the second cylindrical member 56 and the lift cam 46 are rotated with the rotation of the rotating body 42.

Figure 14:
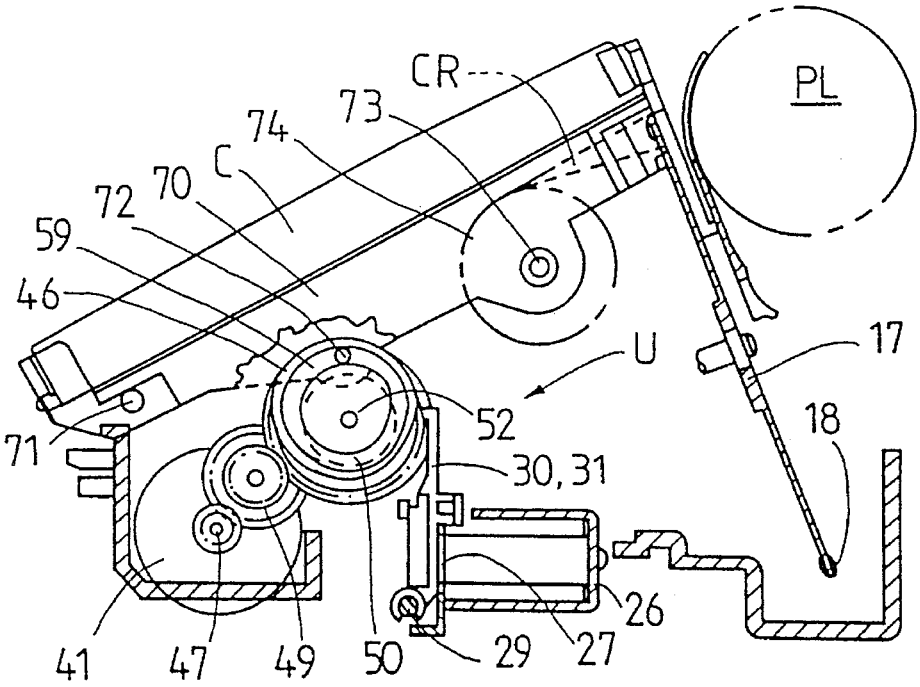
FIG. 14 is a side view showing the ribbon lift mechanism.

The lift cam 46 is formed to have a shape as shown in FIG. 14, and a cam groove 59, formed to have a predetermined shape, is provided on it. A ribbon cassette C, in which a printing ribbon is housed, is placed on the cam groove 59 and the cam groove 59 is engaged with a follower pin 72 provided on a holder member 70 to which a ribbon spool 74 wound with a correction ribbon CR is fixed. Thereby, the follower pin 72 is made to move up or down following the cam groove 59 according to the rotation of the lift cam 46. The result is the holder member 70 is shifted up or down and the operation with the ribbon cassette C or the lift operation of the correction ribbon CR is performed. About this point, a description will be given later.

Figure 13:
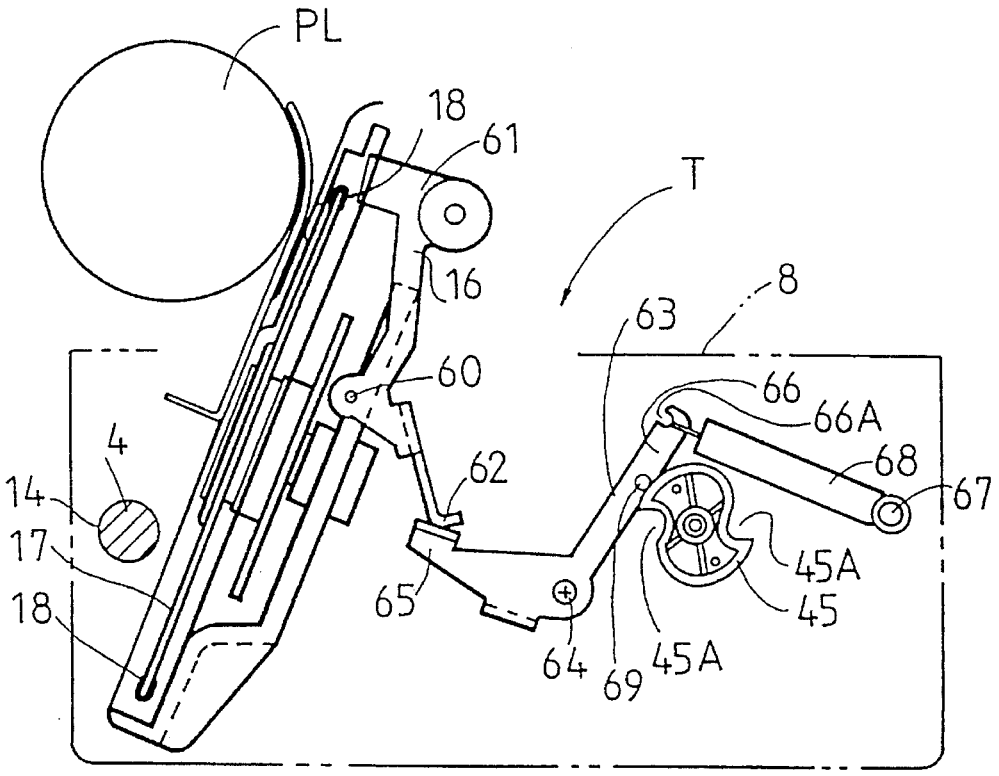
FIG. 13 is a side view showing the printing mechanism.

Next, the printing hammer driving mechanism T will be explained with reference to FIG. 13. FIG. 13 is a side view showing the printing mechanism. The printing hammer 16 is supported at a middle portion by a hammer shaft 60. A type striking portion 61 is formed on the end portion of the printing hammer 16 facing the platen PL. On the other end of the printing hammer 16 an engagement portion 62 is formed. To the rear of the printing hammer 16, a function lever 63 is supported rotatably by a lever shaft 64. A hammer stopping portion 65 is formed on the function lever 63, on the side of the printing hammer 16, and an arm portion 66 is formed on the opposite side of the hammer stopping portion 65. The hammer stopping portion 65 is engaged with the engagement portion 62 of the printing hammer 16 and a pull spring 68 is inserted between a stopping groove 66A, formed on the arm portion 66, and a pin 67 provided on the carriage 8. Further, a cam follower 69 is provided in the approximately central position of the arm portion 66 to contact the hammer cam 45. The hammer cam 45 is formed into the shape shown in FIG. 13. As previously discussed, on its peripheral surface are two depressed parts 45A positioned opposite to one another. Although is not shown in a figure, a torsion spring is supported on the hammer shaft 60 and the printing hammer 16 is energized clockwise (FIG. 13) by the torsion spring. The energizing force of the torsion spring is set to a value which is small compared with that of the pull spring 68.

In the structure as described above, the function lever 63 is constantly energized clockwise by the force of the pull spring 68 and the cam follower 69 is constantly abutted against the peripheral surface of the hammer cam 45. When the hammer cam 45 is rotated, as described above, the cam follower 69 falls into one of the depressed parts 45A as the energizing force of the pull spring 68 acts strongly upon the arm portion of the function lever 63. Thereby, the function lever 63 is turned clockwise abruptly and the hammer stopping portion 65 makes the engagement portion 62 of the printing hammer 16 jump up. As a result, the printing hammer 16 is turned counterclockwise centered on the hammer shaft 60 and a type element 18 on the type wheel 17 is struck by the type striking portion 61 and a character is printed on a printing paper supported on the platen PL.

Next, the ribbon lift mechanism U, which lifts a ribbon cassette C or a correction ribbon CR with the lift cam 46, will be explained referring to FIG. 14. FIG. 14 is a side view showing the ribbon lift mechanism.

In FIG. 14, a holder member 70 is held rotatably by a shaft 71. A ribbon cassette C, which houses a printing ribbon, is placed on the holder member 70. A follower pin 72 inserted into the cam groove 59 of the lift cam 46 is provided on the side wall of the holder member 70. Further, a spool shaft 73 is formed to the front of the follower pin 72 (FIG. 14) and a ribbon spool 74, which is wound with a correction ribbon CR, is fixed on the spool shaft 73.

When the lift cam 46 is rotated, as described above, the follower pin 72 is moved upward or downward following the cam groove 59 according to the rotation of the lift cam 46; thereby, the holder member 70 is moved upward or downward and the lift operation of the ribbon cassette C or the correction ribbon CR is performed.

FIG. 14 shows a state where the ribbon spool 74 of a correction ribbon CR is lifted by the ribbon lift mechanism U. In this state, when the printing hammer driving mechanism T is driven, the printing hammer 16 strikes a type element 18 through the correction ribbon CR to perform the correction of a misprinted character. On the other hand, when a character is printed through a printing ribbon in the ribbon cassette C, the lift cam 46 is rotated by 180 degrees from the state shown in FIG. 14 and the follower pin 72 is guided along the cam groove 59 and the holder member 70 is moved downward to make the printing ribbon and the type element 18 face each other. After that, when the printing hammer driving mechanism T is driven, the printing hammer 16 strikes a type element 18 through a printing ribbon to print a character.

Since a feed mechanism for the correction ribbon CR and the feed mechanism for the printing ribbon housed in the ribbon cassette C are identical to the mechanisms described in U.S. Pat. No. 4,746,236, explained in the preceding pages "Description of the Related Art" an explanation about them will be omitted.

The operation of mechanisms structured as described above, such as those of the carriage moving mechanism O, the pivotal mechanism P, the selecting mechanism R, the operation mechanism S and the printing hammer driving mechanism T, the printing operation of the printing hammer 16 performed through the ribbon lift mechanism U, and the lift operation of a correction ribbon CR will be explained in the following.

First, the printing operation will be explained. When characters are printed, the carriage 8 is moved in direction A in FIG. 1 (to the right) by the carriage motor 9. In this case, the carriage motor 9 and the pinion 11 are rotated clockwise (FIG. 1) and the intermediate gear 130 is rotated counterclockwise. Based on the counterclockwise rotation of the intermediate gear 130, the carriage 8 is moved in direction A through the engagement of the gear teeth 130B with the rack teeth 6A.

When the carriage 8 is moved in direction A, since the gear teeth 22A of the gear 22 are in gear with the rack teeth 6A of the rack 6 through the passive gear 13, the pivotal lever 21 is turned clockwise by a predetermined quantity until the slip occurs between the pivotal lever 21 and the gear 22 and the pivotal lever 21 is held at the position which is reached by the turn (FIG. 4). Corresponding to the turn of the pivotal lever 21, the pin 23 of the pivotal lever 21 presses the pendulum member 24 to the left (FIG. 4) by movement in the longish hole 25 of the pendulum member 24. Thereby, the pendulum member 24 is moved to the left side centering the supporting pin 24C in the armature 27 (FIGS. 4 and 10), until the hanging-down piece 24B is abutted against a regulating piece 27A. At the time, the stopping portion 28 is engaged with the engagement piece 33 of the selecting member 30. As described, when the carriage 8 is moved in the printing direction (direction A in FIG. 1) during a printing operation, following the movement of the carriage 8, the side of the selecting member 30 is selected by the pivotal lever 21 and the pendulum member 24. This state is shown in FIGS. 4, 8 and 10.

After that, when the solenoid 26 is energized, the armature 27 is attracted electromagnetically to the side of the solenoid 26. Thereby, in the state where the engagement portion 28 is engaged with the engagement piece 33, the pendulum member 24 is turned clockwise in FIG. 8, together with the armature 27, centering the shaft 29, and in the similar way, the selecting member 30 is turned clockwise against the force of the pull spring 36. As a result, the stopping claw 32 which is formed on the upper end of the selecting member 30 is released from the stopping projection 55 of the first cylindrical member 54. This state is shown in FIGS. 5 and 9.

The rotating body 42 in the operation mechanism S is constantly rotated in a definite direction (a direction in which the stopping claw 32 of the selecting member 30 can be engaged with the stopping projection 55 of the first cylindrical member 54) by the driving motor 41 through the pinion 47 fixed on the driving shaft 41A, the idle gear 49, and the driven gear 50. At this time, the first cylindrical member 54 is in a stationary state where the rotation is stopped, because the clutch is disengaged OFF by the clutch spring 43 which is disposed between the first supporting portion 52 and the first cylindrical member 54 by the engagement of the stopping claw 32 with the stopping projection 55.

When the engagement of the stopping claw 32 with the stopping projection 55 is released by the energizing of the solenoid 26, the clutch spring 43 is changed to the state of clutch ON, so that the first supporting portion of the rotating body 42 and the first cylindrical member 54, and the first cylindrical member 54 and the hammer cam 45 are respectively connected through the clutch spring 43. As a the result, the rotation of the rotating body 42 is transmitted to the hammer cam 45 and the hammer cam 45 is rotated.

When the hammer cam 45 is rotated, following the rotation, the hammer cam 45 makes the function lever 63 turn counterclockwise (FIG. 13) centering the lever shaft 64 against the spring force of the pull spring 67 through the cam follower 69. When the function lever 63 is turned by a predetermined quantity, the cam follower falls into the depressed part 45A. At this instant, the function lever 63 is abruptly turned clockwise by the force of the pull spring 68. Thereby, the printing hammer 16 is turned counterclockwise centering the hammer shaft 60 through the hammer stopping portion 65 of the function lever 63 and the engagement portion 62 of the printing hammer 16. The result is the type striking portion 61 strikes the type element 18 on the type wheel 17 through a printing ribbon in the ribbon cassette C and the printing of a character on a printing paper is performed.

Next, the lift operation for a correction ribbon CR will be explained. In this case, the carriage 8 is made to backspace by a space which is a little larger than one character space in the direction B (FIG. 1) in order to correct a character, which is misprinted on a printing paper, using a correction ribbon. When a character is to be corrected by striking a type element 18 of a misprinted character by the printing hammer 16 through a correction ribbon CR, the carriage 8 is moved in the arrow direction A. Such a movement operation of the carriage 8 is performed every time a character is corrected. The reason why the carriage 8 is moved as described above for correcting a character is that correction of the backlash generated between the gears provided in various mechanisms is necessary for the execution of accurate character correction.

At first, when a character correction is to be performed, the carriage 8 is moved in the direction B (FIG. 1, to the right) by the carriage motor 9. In this case, the carriage motor 9 and the pinion 11 are rotated counterclockwise (FIG. 1), so that the intermediate gear 130 is rotated clockwise. Based on the clockwise rotation of the intermediate gear 130, the carriage 8 is moved in the direction B through the engagement of the gear teeth 130B with the rack teeth 6A of the rack 6.

When the carriage 8 is moved in the direction B, since the gear teeth 22A of the gear 22 are engaged with the rack teeth 6A of the rack 6 through a passive gear 13, the pivotal lever 21 is turned counterclockwise by a predetermined distance until slippage occurs between the pivotal lever 21 and the gear 22. The pivotal lever is held at the position reached by the turn (FIG. 6). Corresponding to the turn of the pivotal lever 21, the pin 23 of the pivotal lever 21 presses the pendulum member 24 toward the right side (FIG. 6) in moving in the longish hole 25 of the pendulum member 24. Thereby, the pendulum member 24 is turned (to the right in FIGS. 6, 11), centering the supporting pin 24C on the armature 27, until the hanging-down portion 24B is abutted against the regulation piece 27A. At that point, the stopping portion 28 is engaged with the engagement piece 38 of the selecting member 31. As described above, when the carriage 8 is moved in the character correction direction (direction B in FIG. 1) during the printing operation, the side of the selecting member 31 is selected through the pivotal lever 21 and the pendulum member 24 following the movement of the carriage 8. The state is shown in FIGS. 6, 8 and 11.

After that, when the solenoid is energized, the armature 27 is attracted to the side of the solenoid 26. Thereby, in the state where the engagement portion 28 of the pendulum member 24 is engaged with the engagement piece 38 of the selecting member 31, the pendulum member 24 is turned clockwise (FIG. 8) centering the shaft 29 together with the armature 27. The selecting member 31 is also turned clockwise against the force of the pull spring 40. As a result, the stopping claw 37, which is formed on the upper end of the selecting member 31, is released from the stopping projection 57 of the second cylindrical member 56 (FIGS. 7 and 9).

The rotating body 42 in the operation mechanism S is rotated constantly by the driving motor 41 in a definite direction (a direction in which the stopping claw 37 of the selecting member 31 and the stopping projection 57 of the second cylindrical member 56 are to be engaged with each other) through the pinion 47 fixed on the driving motor shaft 41A, the idle gear 49, and the driven gear 50. In this case, the second cylindrical member 56 remains stationary because the clutch spring 44, which is disposed between the second supporting portion 53 and the second cylindrical member 56, is in an OFF state by the engagement of the stopping claw 37 with the stopping projection 57.

As described above, when the engagement of the stopping claw 37 with the stopping projection 57 is released by energizing the solenoid 26, the clutch spring 44 brings the clutch to ON. Thereby, the second supporting portion 53 of the rotating body and the second cylindrical member 56, and the second cylindrical member 56 and the ribbon lift cam 46, are connected to each other through the clutch spring 44. As a result, the rotation of the rotating body 42 can be transmitted to the ribbon lift cam 46 and the ribbon lift cam 46 is rotated.

As described above, when the ribbon lift cam 46 is rotated, the cam follower 72 is moved upward along the cam groove 59 formed on the ribbon lift cam 46. Thereby, the holder member 70 is moved upward following the upward movement of the cam follower 72 and, following the above, a ribbon spool 74, wound with a correction ribbon CR, is lifted upward until it reaches the position shown in FIG. 14 where the ribbon spool 74 stays until the printing hammer 16 impacts the type wheel 17 against the correction ribbon CR. At the time, the correction ribbon CR and the type element 18 on the type wheel 17 face each other.

Then, in order to correct a misprinted character, on a printing paper, by striking it with the printing hammer 16 through the correction ribbon CR, the carriage 8 is moved in the direction A (FIG. 1) while the correction ribbon CR is lifted. Based on the movement of the carriage 8 toward the direction A, the carriage movement mechanism O, the pivotal mechanism P, the selecting mechanism Q, the solenoid mechanism R, and the operation mechanism S are operated in the same way as the printing operation explained in the preceding pages. After that the correcting operation is performed which is the same as the operation described above concerning the printing hammer driving mechanism T. Thereby, misprinted characters on a printing paper can be corrected with a correction ribbon CR.

Figure 15:
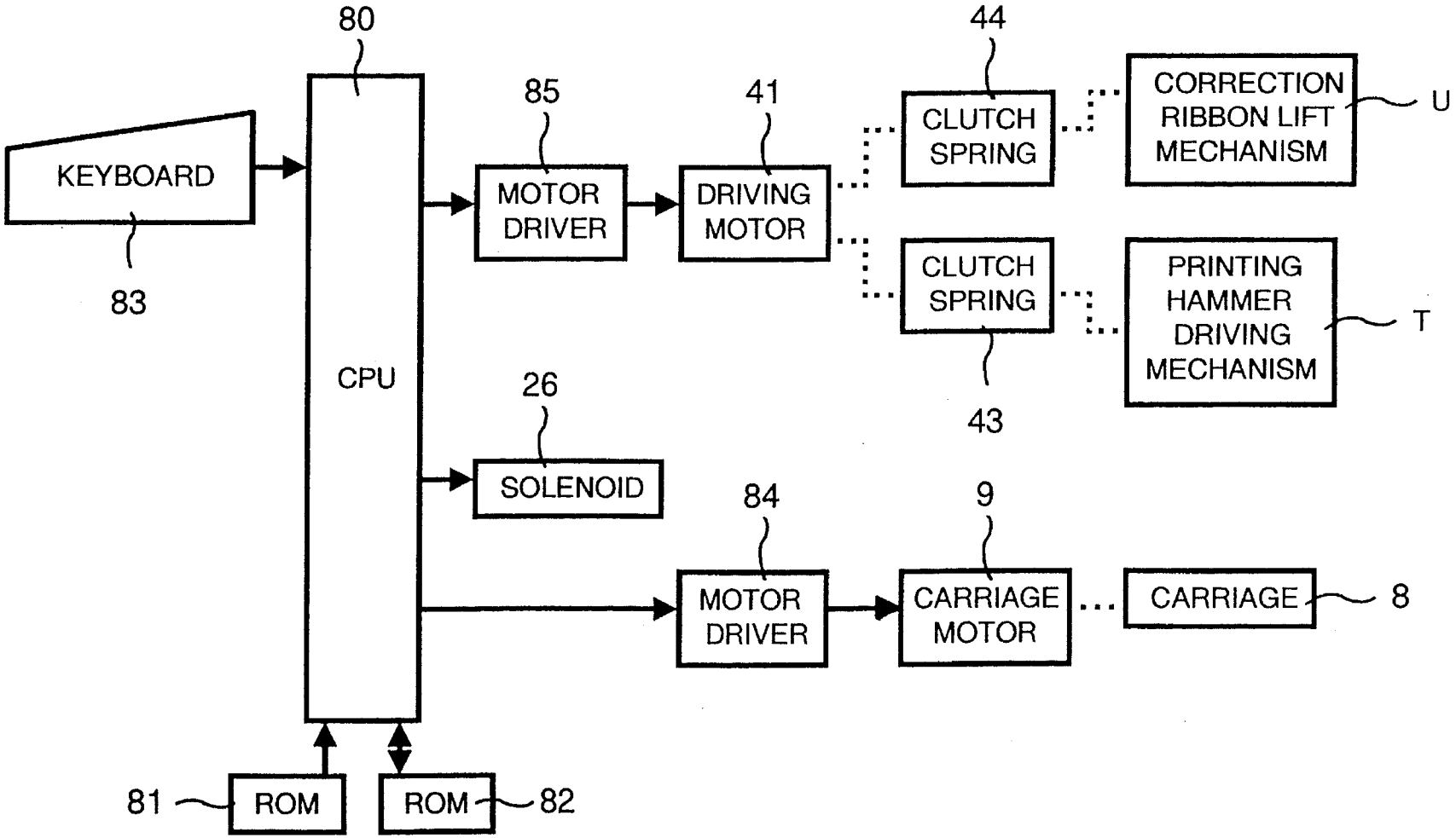
FIG. 15 is a control block diagram of the typewriter.

Next, the control system of a typewriter 1 according to the invention will be explained referring to FIG. 15. FIG. 15 is a block diagram of the control system of the typewriter 1 according to the invention. In FIG. 15, the control system of the typewriter 1 comprises a CPU 80, which controls various kinds of functions of the typewriter 1, a ROM 81, which stores various kinds of control programs and various kinds of data tables which are necessary for the control of the typewriter 1, and a RAM 82, which temporarily stores the results of operations (data) operated by the CPU 80. A keyboard 83 is also connected to the CPU 80. The CPU 80 performs various kinds of operations according to the programs stored in the ROM 81 based on the data input from character keys or the function keys provided on the keyboard 83.

The solenoid 26 is also connected to the CPU 80. The solenoid 26 is energized at a predetermined timing under the control of the CPU 80. Thereby, as described above, the engagement of the stopping claw 32 of the selecting member 30 with the stopping projection 55 of the first cylindrical member 54, or the engagement of the stopping claw 37 of the selecting member 31 with the stopping projection 57 of the second cylindrical member 56 are selectively released. Further, the carriage motor 9 is connected to the CPU 80 through a motor driver 84. When characters are printed, the carriage motor 9, under the control of the CPU 80, moves the carriage 8 in the direction A (FIG. 1). When misprinted characters are to be corrected, the carriage 8 is initially moved in the direction B (FIG. 1).

Further, the driving motor 41 is connected to the CPU 80 through the motor driver 85. The driving motor 41 is controlled to rotate in a definite direction through the motor driver 85 based on the control signal from the CPU 80. The pivotal mechanism P and the selecting mechanism Q are operated by the rotation of the driving motor 41 and the clutch ON or OFF, caused by the state of the clutch springs 43, 44 in the operation mechanism S, is performed selectively, which makes it possible to operate selectively the printing hammer driving mechanism T or the correction ribbon lift mechanism U.

As explained in detail above, in the case of the typewriter 1 according to the present embodiment, when characters are printed on a printing paper, the carriage 8 is moved in the printing direction (direction A in FIG. 1) by the carriage motor. Based on the movement of the carriage 8, the pivotal lever 21 is turned to keep the pendulum member 24 and the selecting member 30 engaged with each other and the solenoid 26 is energized, keeping the engaged state as it is, to release the engagement of the selecting member 30 with the first cylindrical member 54 and, by the release, the clutch spring 43 is brought to clutch ON and the hammer cam 45 is made to rotate together with the rotating body 42 which is rotated by the driving motor 41 for the purpose of operating the printing hammer mechanism T; when the correction of misprinted characters is performed, the carriage 8 is moved toward the character correcting direction (direction B in FIG. 1) by the carriage motor 9 and, based on the movement of the carriage 8, the pivotal lever 21 is turned to keep the engaged state of the pendulum member 24 with the selecting member 31. In keeping the engaged state, the solenoid 26 is energized to release the engagement of the selecting member 31 with the second cylindrical member 56 and, by the release the clutch spring 44, is made to be in the state of clutch ON and the ribbon lift cam 46 is rotated together with the rotating body 42 which is rotated by the driving motor 41 for the purpose of operating the ribbon lift mechanism U, which makes it possible to connect the driving motor 41 selectively to the printing hammer driving mechanism T or to the ribbon lift mechanism U using one solenoid 26.

As described in the above, different from a conventional typewriter in which a solenoid for the printing hammer mechanism and another solenoid for the ribbon lift mechanism were needed, in a typewriter according to the invention, one solenoid 26 is good enough for the operation so that the cost of the typewriter 1 can be reduced by decreasing the number of solenoids.

The invention is not limited to the above-mentioned embodiment and it is obvious that various kinds of improvements or modifications may be possible within the scope of the invention.

What is claimed is:

1. A print mechanism using a type wheel, having a plurality of type elements, the type wheel mounted on a carriage movement mechanism which moves a carriage in a first direction or a second direction opposite to the first direction along a platen, comprising:

a pivotal mechanism having a pair of stopping portions, a first stopping portion and a second stopping portion, which are turned to a first position when the carriage is moved in the first direction and turned to a second position when the carriage is moved in the second direction by the carriage movement mechanism;

an operation mechanism comprising a rotating body which is rotated by a driving motor having a first supporting portion and a second supporting portion, a first cylindrical member which is engaged with a first supporting portion with play being provided with a first stopping projection in the circumference, a second cylindrical member which is engaged with a second supporting portion with play being provided with a second stopping projection in the circumference, a first clutch mechanism which connects or disconnects the transmission of the rotating force from the rotating body disposed between the first supporting portion and the first cylindrical member, a second clutch mechanism which connects or disconnects the transmission of the rotating force from the rotating body being disposed between the second supporting portion and the second cylindrical member, a hammer cam member which is rotated following the rotation of the first cylindrical member, and a lift cam member which is rotated following the rotation of the second cylindrical member;

a printing hammer driving mechanism which strikes type elements on the type wheel with the printing hammer responsive to the rotation of the above-mentioned hammer cam member;

a ribbon lift mechanism which shifts a correction ribbon up or down corresponding to the rotation of the lift cam member;

a selecting mechanism comprising a first selecting member in which a first engagement portion is provided which can be selectively engaged with the first stopping portion of the above-mentioned pivotal mechanism and which has a first stopping claw to be engaged with the first stopping projection of the first cylindrical member and selects the printing hammer driving mechanism, and a second selecting member in which a second engagement portion is provided which can be selectively engaged with the second stopping portion of the pivotal mechanism and which has a second stopping claw to be engaged with the second stopping projection of the second cylindrical member and selects the ribbon lift mechanism; and a solenoid mechanism which releases the engagement of the first stopping claw with the first stopping projection of the first cylindrical member in a state where the first stopping portion of the above-mentioned pivotal mechanism is being engaged with the first engagement portion of the first selecting member and also releases the engagement of the second stopping claw with the second stopping projection of the second cylindrical member in a state where the second stopping portion of the pivotal mechanism is being engaged with the second engagement portion of the second selecting member.

2. The print mechanism according to claim 1, wherein said print mechanism further comprises a guide shaft and a rack having rack teeth mounted in a printer body parallel to the platen and said carriage is mounted on said guide shaft and said rack.

3. The print mechanism according to claim 2, wherein said pivotal mechanism comprises:

a passive gear mounted on said carriage and having teeth for engaging said rack teeth;

a pivotal lever which moves between the first position and a second position; and a rotating gear having teeth to engage said gear teeth of said passive gear, said rotating gear in slipping contact with said pivotal lever so that a load greater than a predetermined level causes said rotating gear to slip relative to said pivotal lever and said pivotal lever is held in one of said first position and said second position.

4. A print carriage mechanism for a printer having a platen, comprising:

a carriage mounting a type wheel having a plurality of type elements and mounting a correction ribbon;

a carriage movement mechanism mounted to said carriage for moving said carriage in a first direction and a second direction opposite to the first direction along said platen;

a pivotal mechanism mounted to said carriage which rotates to a first position when said carriage moves in the first direction and to a second position when the carriage moves in the second direction;

a printing hammer driving mechanism mounted to said carriage for driving a print hammer to strike a type element of the type wheel;

a ribbon lift mechanism mounted to said carriage for lifting the correction ribbon;

a selecting mechanism mounted to said carriage for selecting a one of said printing hammer driving mechanism and said ribbon lift mechanism for operation based on the position of said pivotal mechanism;

a solenoid mechanism mounted to said carriage for operating both said printing hammer driving mechanism and said ribbon lift mechanism;

a control mechanism for controlling operation of said solenoid; and an operation mechanism mounted to said carriage for operating said ribbon lift mechanism and said printing hammer driving mechanism.

5. The print carriage mechanism according to claim 4, wherein said print carriage mechanism further comprises a guide shaft and a rack having rack teeth mounted in the printer parallel to the platen and said carriage is mounted on said guide shaft and said rack.

6. The print carriage mechanism according to claim 5, wherein said carriage movement mechanism further comprises:

a motor mounted to said carriage;

a motor shaft extending from said motor;

a pinion fixed to an extending end of said motor shaft, said pinion having teeth; and an intermediate gear mounted to said carriage, said intermediate gear having gear teeth engaging said rack teeth and said teeth of said pinion.

7. The print carriage mechanism according to claim 6, wherein said carriage movement mechanism further comprises:

a plate, said plate pivotally mounted to said carriage, said motor and said intermediate gear mounted to said plate; and a spring connected between said carriage and said plate for rotatably urging said gear teeth into engagement with said rack teeth.

8. The print carriage mechanism according to claim 5, wherein said pivotal mechanism comprises:

a passive gear mounted on said carriage and having teeth for engaging said rack teeth;

a pivotal lever which moves between the first position and a second position; and a rotating gear having teeth to engage said gear teeth of said passive gear, said rotating gear in slipping contact with said pivotal lever so that a load greater than a predetermined level causes said rotating gear to slip relative to said pivotal lever and said pivotal lever is held in one of said first position and said second position.

9. The print carriage mechanism according to claim 8, wherein said selecting mechanism comprises:

a pendulum member movably connected with an end of said pivotal lever;

a pair of identical selecting members positioned to either side of said pendulum member;

a shaft parallel to said platen to which said pair of selecting members are pivotally mounted, wherein each of said selecting members has a claw at a free end and movement of said pendulum member is limited by contact with either one of said pair of selecting members.

10. The print carriage mechanism according to claim 9, wherein said selecting mechanism further comprises means for urging each of said pair of selecting members toward a latching position.

11. The print carriage mechanism according to claim 9, wherein said operating mechanism comprises:

a driving motor;

a gear train connected to and driven by said driving motor;

a rotating body which is driven to rotate by said gear train, said rotating body rotatably mounted to a supporting shaft mounted on said carriage;

a first supporting portion and a second supporting portion being a part of said rotating body;

a first cylindrical member slidably mounted on said first supporting portion;

a second cylindrical member slidably mounted on said second supporting portion;

a first clutch spring between said first supporting portion and said first cylindrical member;

a second clutch spring between said second supporting member and said second cylindrical member;

a hammer cam, having two depressed regions in an outer peripheral surface, is rotatably mounted on said supporting shaft at a first end of said rotating body adjacent said first supporting portion; and a lift cam, having a cam groove, is rotatably mounted on said supporting shaft at a second end of said rotating body adjacent said second supporting portion.

12. The print carriage mechanism according to claim 11, wherein said driving motor rotates in a single direction.

13. The print carriage mechanism according to claim 11, wherein said rotating body further comprises a driven gear positioned between said first supporting portion and said second supporting portion, said driven gear having teeth engaged with said gear train for transferring rotation of said driving motor into rotation of said rotating body.

14. The print carriage mechanism according to claim 11, wherein said first cylindrical member and said second cylindrical member each have a first stop projection and a second stop projection on opposite sides of their outer peripheral surfaces, said first and second stop projections engaged by said claw of a respective one of said pair of selecting members.

15. The print carriage mechanism according to claim 14, wherein said first clutch spring connects said first supporting portion, said first cylindrical member and said hammer cam when said claw of a respective one of said selecting members is not engaged to a one of said first and second stop projections of said first cylindrical member, and said second clutch spring connects said second supporting portion, said second cylindrical member and said lift cam when said claw of a respective other one of said selecting members is not engaged to a one of said first and second stop projections of said second cylindrical member.

16. The print carriage mechanism according to claim 15, wherein said printing hammer driving mechanism has a cam follower resting on and following the outer peripheral surface of said hammer cam.

17. The print carriage mechanism according to claim 16, wherein said printing hammer driving mechanism causes said print hammer to strike said type element when said cam follower enters one of the two depressed regions of said hammer cam.

18. The print carriage mechanism according to claim 15, wherein said ribbon lift mechanism has a pin follower for engaging and following said cam groove of said lift cam to position the correction ribbon for use.

19. The print carriage mechanism according to claim 15, wherein said solenoid mechanism comprises:

an armature rotatably mounted to said shaft;

a solenoid; and a tension means for continuously urging said armature to rotate away from said solenoid.

20. The print carriage mechanism according to claim 19, wherein said pendulum member has a hanging portion engaged with said armature such that activation of said solenoid causes said armature to rotate into contact with said solenoid, the rotation moving said pendulum member and said selecting member with which said pendulum member is in contact so as to disengage an engaged claw from an opposing stop projection.

* * * * *